US006886760B2

(12) United States Patent
Potz et al.

(10) Patent No.: US 6,886,760 B2
(45) Date of Patent: May 3, 2005

(54) FUEL INJECTION VALVES FOR INTERNAL COMBUSTION ENGINES

(75) Inventors: Detlev Potz, deceased, late of Stuttgart (DE); by Wendelin Potz, legal representative, Stuttgart (DE); by Maike Sander-Potz, legal representative, Stuttgart (DE); Friedrich Moser, Ludwigsburg (DE); Thomas Kuegler, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 117 days.

(21) Appl. No.: 10/203,978

(22) PCT Filed: Nov. 28, 2001

(86) PCT No.: PCT/EP01/13921

§ 371 (c)(1),
(2), (4) Date: Oct. 28, 2002

(87) PCT Pub. No.: WO02/48536

PCT Pub. Date: Jun. 20, 2002

(65) Prior Publication Data

US 2004/0031863 A1 Feb. 19, 2004

(30) Foreign Application Priority Data

Dec. 16, 2000 (DE) ..... 100 62 959

(51) Int. Cl.[7] ..... F02M 59/00

(52) U.S. Cl. ..... 239/533.2; 239/88; 239/533.11; 123/467

(58) Field of Search ..... 239/88, 90, 91, 239/124, 125, 96, 533.1–533.3, 533.9, 533.11; 123/467, 496

(56) References Cited

U.S. PATENT DOCUMENTS 5,860,597 A * 1/1999 Tarr ..... 239/124
5,899,385 A * 5/1999 Hofmann et al. ..... 239/124
6,422,208 B1 * 7/2002 Ertem et al. ..... 123/467
6,527,198 B1 * 3/2003 Stoecklein ..... 239/102.2

* cited by examiner

*Primary Examiner*—Dinh Q. Nguyen
(74) *Attorney, Agent, or Firm*—Ronald E. Greigg

(57) ABSTRACT

A fuel injection valve with a valve body has a bore that contains a piston-shaped valve member. The valve member is guided in the bore with a sealing section and a guiding section; between the sealing section and the guiding section, the valve member is encompassed by a first pressure chamber and between the guiding section and the combustion chamber end, is encompassed by a second pressure chamber. In the guiding section of the valve member, an annular collar is provided and has a side oriented toward the combustion chamber and a side oriented away from the combustion chamber. The annular collar has a throttle connection embodied on it, which connects the sides of the annular collar to each other and thus produces a throttled connection from the first pressure chamber to the second pressure chamber.

6 Claims, 3 Drawing Sheets

FUEL INJECTION VALVES FOR INTERNAL COMBUSTION ENGINES

CROSS-REFERENCE TO RELATED APPLICATIONS

This application is a 35 U.S.C. 371 application of PCT/EP 01/13921, filed on Nov. 28, 2001.

BACKGROUND OF THE INVENTION

1. Field of the Invention

The invention is directed to an improved fuel injection valve for internal combustion engines.

2. Description of the Prior Art

A fuel injection valve of the type with which this invention is concerned is disclosed by the reference DE 198 57 244 A1 in which a valve body has a bore in which a piston-shaped valve member is contained so that it can slide longitudinally counter to a closing force. At its end oriented toward the combustion chamber, the valve member transitions into a valve sealing surface, which cooperates with a valve seat and thus controls the opening of at least one injection opening. The valve member is guided in the bore in a sealing section oriented away from the combustion chamber and in a guiding section oriented toward the combustion chamber. The guiding section includes an annular collar remote from the combustion chamber, which is separated by an annular groove from lateral recesses embodied on the valve member so that fuel can flow past through these recesses, between the wall of the bore and the valve member. On its side oriented toward the combustion chamber, the annular collar has a control edge, which cooperates with a sealing edge embodied on the wall of the bore. In addition, a bore is embodied in the valve member, which extends obliquely in relation to the longitudinal axis of the valve member and connects the pressure chamber, which is embodied on the side of the annular collar oriented away from the combustion chamber, between the valve member and the wall of the bore, to one of the recesses in the guiding section of the valve member. The bore is embodied as a throttle bore so that fuel can flow in a throttled fashion from the pressure chamber to the recesses and therefore to a second pressure chamber, which is embodied between the valve member and the wall of the bore, between the guiding section and the valve sealing surface. When the fuel injection valve is closed, the valve sealing surface of the valve member rests against the valve seat and the control edge on the annular collar is disposed closer to the combustion chamber than the sealing edge so that the first pressure chamber is connected to the second pressure chamber only by means of the throttle bore. If an injection is to take place, highly pressurized fuel is introduced into the first pressure chamber and flows from there through the throttle bore into the second pressure chamber as well. If the hydraulic force on the valve member is sufficient to move it away from the valve seat counter to the closing force, then the valve sealing surface lifts up from the valve seat and fuel is injected through the injection opening into the combustion chamber of the engine. As long as the annular collar is disposed closer to the combustion chamber than the sealing edge, only a small amount of fuel can travel from the first pressure chamber, through the throttle bore, and into the second pressure chamber. In the course of the opening movement of the valve member, when the control edge passes the sealing edge, then the first pressure chamber is connected to the second pressure chamber by means of the annular groove and the recesses in the guiding section of the valve member and fuel can flow from the first pressure chamber into the second pressure chamber in a virtually unthrottled manner. This increases the pressure in the second pressure chamber and consequently the rate of injection so that on the whole, a shaping of the rate-of-discharge curve is achieved in which only a small amount of fuel is injected at the beginning of the opening stroke motion due to the relatively low pressure in the second pressure chamber, and the main quantity of the fuel is injected at high pressure only in the subsequent main injection. In this connection, however, the known fuel injection valve has the disadvantage that the necessary throttle bore is expensive to produce, which makes the manufacture quite cost intensive. There is also the disadvantage that because of the necessary clampings of the valve member, the throttle bore must already be produced in an early stage of the manufacturing process, which makes it impossible to subsequently adapt the throttle bore to other tolerances that come up.

SUMMARY OF THE INVENTION

The fuel injection valve according to the invention has the advantage over the prior art that the throttle cross section between the first pressure chamber and the second pressure chamber is produced by means of a throttle conduit, which connects the two sides of the annular collar to each other. This throttle conduit can be produced after the production of the entire valve member, thus permitting an adaptation to other tolerances of the injection valve, for example the size of the annular gap between the annular collar and the bore of the valve body.

In a first advantageous embodiment of the subject of the invention, the throttle conduit is embodied as a throttle bore, which extends in the annular collar at least approximately parallel to the longitudinal axis of the valve member. A throttle bore of this kind can be advantageously produced by means of laser drilling, which is a contactless process, so that the throttle bore can be easily produced after completion of the entire valve member. It is also possible for a large number of such throttle bores to be provided, distributed over the circumference of the annular collar in order to assure a uniform flow of the fuel from the first pressure chamber into the second pressure chamber. The throttle bores in this connection are preferably disposed so that one of the recesses in the guiding section of the valve member is disposed in the extension of the throttle bore toward the combustion chamber so that the side of the annular collar oriented toward the combustion chamber can be freely accessed by a laser beam coming from the end of the valve member oriented toward the combustion chamber.

In another advantageous exemplary embodiment of the fuel injection valve according to the invention, the throttle connection is produced by means of at least one lateral grinding on the annular collar. These grindings can be embodied as fiat, which configuration is easy to produce and permits the cross section of the throttle connection to be adjusted very precisely.

BRIEF DESCRIPTION OF THE DRAWINGS

Various exemplary embodiments of the fuel injection valve according to the invention are described herein below with reference to the drawings in which.

DESCRIPTION OF THE PREFERRED EMBODIMENTS

Figure 1:
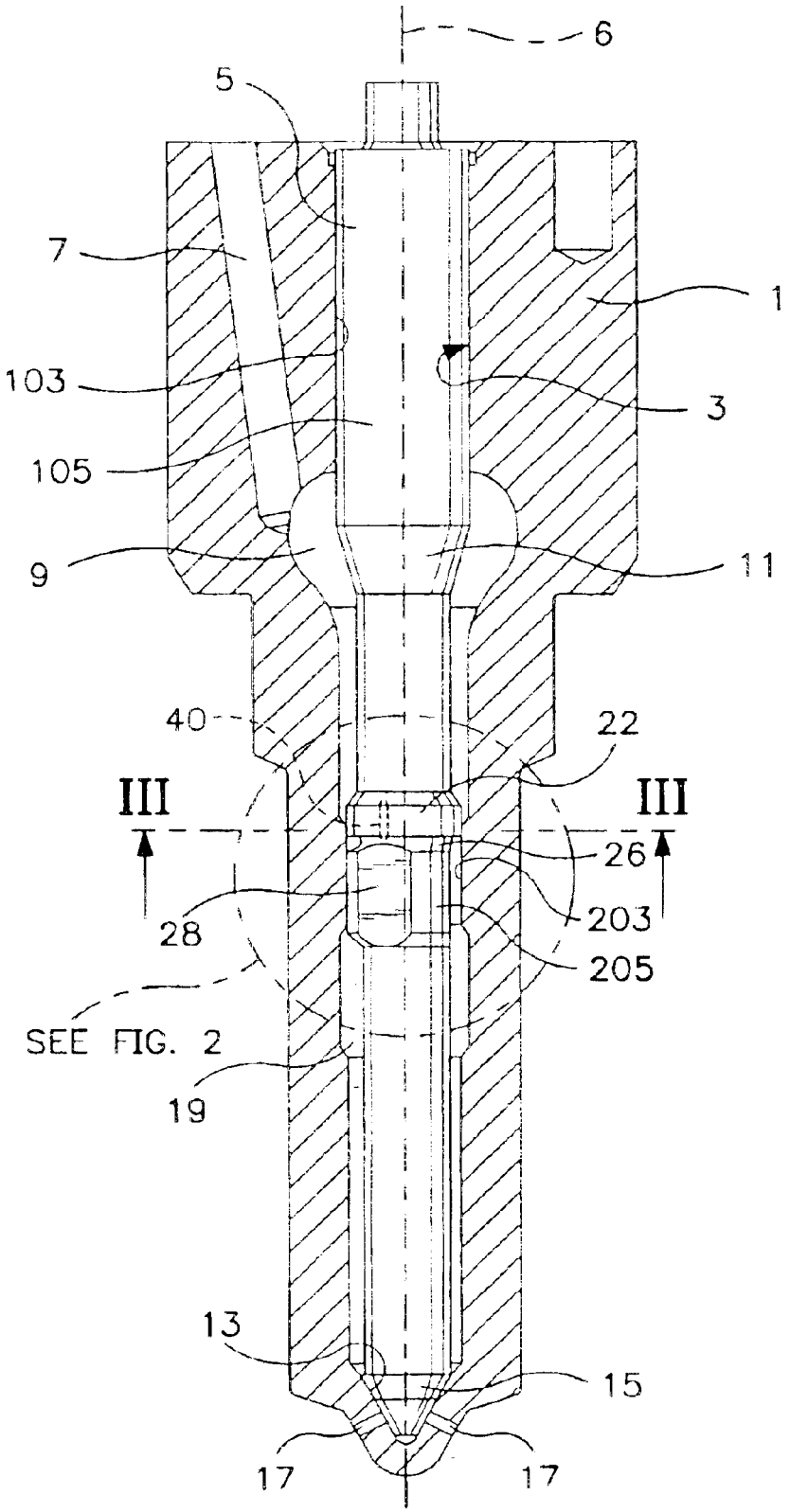
FIG. 1 shows a longitudinal section through a fuel injection valve according to the invention, with a valve member that is not cut away.

FIG. 1 shows a longitudinal section through a fuel injection valve according to the invention. The valve body 1 contains a bore 3, which is open at the end of the valve body 1 oriented away from the combustion chamber and transitions into an essentially conical valve seat 13 at the end oriented toward the combustion chamber. At the end of the bore 3 oriented toward the combustion chamber, at least one injection opening 17 is embodied, which connects the bore 3 to the combustion chamber of the internal combustion engine that is not shown in detail in the drawing. The bore 3 contains a piston-shaped valve member 5 in a longitudinally movable fashion. The valve member 5 is guided in the bore 3 in a sealed fashion with a sealing section 105 in a bore sealing section 103 remote from the combustion chamber and is also guided with a guiding section 205 in a bore guiding section 203 oriented toward the combustion chamber. At its end oriented toward the combustion chamber, the valve member 5 transitions into a valve sealing surface 15, which is essentially conically embodied and cooperates with the valve seat 13 so that the injection openings 17 are closed when the valve sealing surface 15 contacts the valve seat 13 and are opened when the valve sealing surface 15 lifts up from the valve seat 13. Between the bore sealing section 103 and the bore guiding section 203 a first pressure chamber 9 is formed between the valve member 5 and the wall of the bore 3 and can be connected to a high-pressure fuel source, not shown in the drawing, by means of a supply conduit 7 extending in the valve body 1. Between the bore guiding section 203 and the valve seat 13, a second pressure chamber 19 is formed between the valve member 5 and the wall of the bore 3 by means of a radial enlargement of the bore 3 and can be connected to the combustion chamber by means of the injection openings 17 as a function of the interplay between the valve sealing surface 15 and the valve seat 13.

Figure 3:
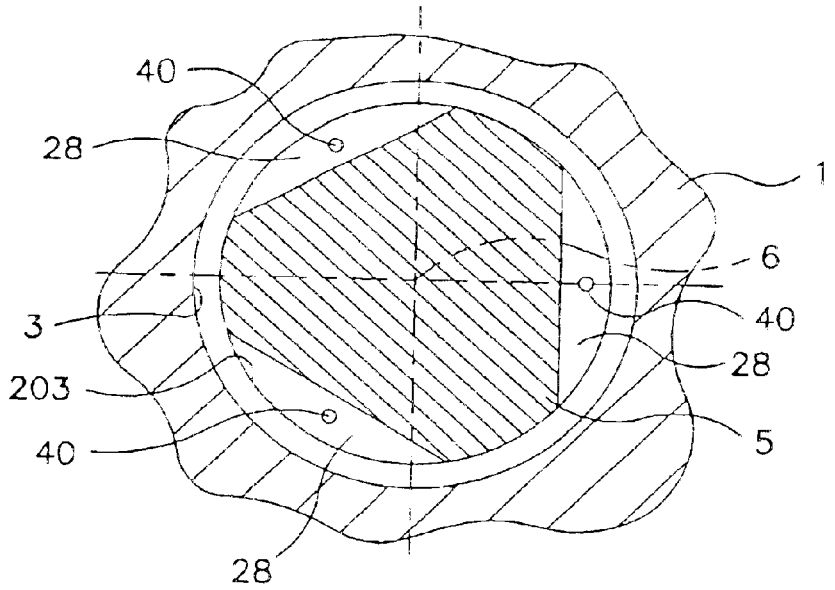
FIG. 3 shows a cross section along the line III—III in FIG. 2.
Figure 2:
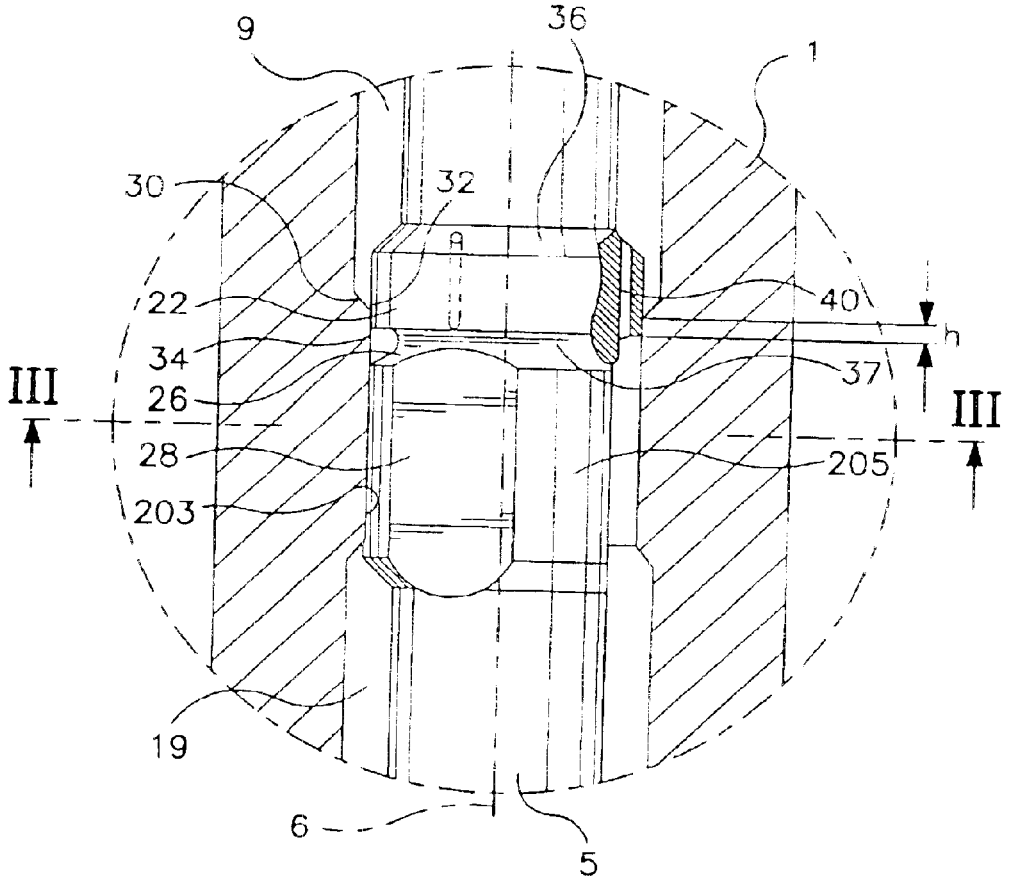
FIG. 2 shows an enlargement from FIG. 1 in the vicinity of the guiding section of the valve member.

FIG. 2 shows an enlarged depiction of FIG. 1 in the vicinity of bore guiding section 203. FIG. 3 shows the corresponding cross section along the line III—III in FIGS. 1 and 2. The guiding section 205 is guided in the bore guiding section 203 and has three flat grindings 28 there so that fuel can flow past the guiding section 205 in the axial direction of the valve member 5. At its end remote from the combustion chamber, the guiding section 205 is adjoined by an annular groove 26, which is in turn adjoined by an annular collar 22. The annular collar 22 is disposed in a radial plane of the valve member 5 and has a side 37 oriented toward the combustion chamber and a side 36 oriented away from the combustion chamber. At the transition of the annular collar 22 to the annular groove 26, a control edge 34 is embodied on the annular collar 22, which plunges into the bore guiding section 203 when the fuel injection valve is closed, i.e. when the valve sealing surface 15 rests against the valve seat 13. The diameter of the bore guiding section 203 here is slightly smaller than the diameter of the bore 3 so that at the transition from the first pressure chamber 9 to the bore guiding section 203, an annular shoulder 30 is produced, which is defined by a sealing edge 32 embodied at the beginning of the bore guiding section 203. The annular collar 22 has a diameter that is only slightly smaller than the diameter of the bore guiding section 203 so that when the fuel injection valve is closed, practically no fuel can flow from the first pressure chamber 9 past the annular collar 22, through the annular groove 26 and the recesses 28, and into the second pressure chamber 19. Three throttle conduits are disposed in the annular collar 22, which are embodied as throttle bores 40 and which connect the side 36 of the annular collar 22 oriented away from the combustion chamber to the side 37 of the annular collar 22 oriented toward the combustion chamber. It is also possible to provide more or fewer than three conduits. The throttle bores 40 are disposed so that they extend at least essentially parallel to the longitudinal axis 6 of the valve member 5 and so that a grinding 28 is disposed in each of their respective extensions oriented toward the combustion chamber.

The valve member 5 is acted on with a closing force by a device that is not shown in the drawing, which presses the valve member 5 with the valve sealing surface 15 against the valve seat 13. Since the valve member 5 tapers from the section guided in the sealing section 103 toward the combustion chamber, a pressure shoulder 11 is embodied on the valve member 5 and is disposed in the first pressure chamber 9. A corresponding fuel pressure in the pressure chamber 9 produces a hydraulic force on the pressure shoulder 11, which force has a component acting in the longitudinal direction of the valve member 5 in opposition to the closing force. In this manner, the valve member 5, controlled by the pressure in the first pressure chamber 9, can be moved in the longitudinal direction counter to the closing force and can therefore open and close the injection openings 17.

The fuel injection valve operates as follows: at the beginning of the injection, highly pressurized fuel is conveyed through the supply conduit 7 into the first pressure chamber 9. From there, the fuel flows through the throttle bores 40 into the second pressure chamber 19, causing the fuel pressure there to increase as well. When the fuel pressure in the first pressure chamber 9 reaches a particular level, the hydraulic force on the pressure shoulder 11 exerts a force counter to the closing force on the valve member 5, which moves this valve member in the axial direction away from the valve seat 13. As a result, the valve sealing surface 15 lifts up from the valve seat 13 and unblocks the injection openings 17. As long as the controlling edge 34 of the annular collar 22 is disposed inside the bore guiding section 203, then the only way the fuel can travel from the first pressure chamber 9 into the second pressure chamber 19 and from there, through the injection openings 17 into the combustion chamber of the engine, is by passing through the throttle bores 40. Due to this throttling of the influx, only a low pressure builds up in the second pressure chamber 19 and therefore at the beginning of the injection, only a small amount of fuel per unit of time is injected into the combustion chamber of the engine. When the control edge 34 reaches the sealing edge 32 and passes it in the opening direction of the valve member 5, then an annular gap is opened between the annular collar 22 and the bore 3, through which the fuel can then flow virtually unthrottled into the annular groove 26 and through the grindings 28, into the second pressure chamber 19. Since considerably more fuel is then flowing into the second pressure chamber 19, the pressure there increases further and fuel can then be injected at a higher pressure and therefore at a higher rate into the combustion chamber of the engine. If the injection is to be terminated, then the fuel supply through the supply conduit 7 is discontinued and, due to the falling fuel pressure in the first pressure chamber 9 and consequently also in the second pressure chamber 19, the hydraulic force on the valve member 5 decreases until the closing force is greater than the axially directed components of the hydraulic forces and the valve member 5 travels back into the closed position.

Figure 5:
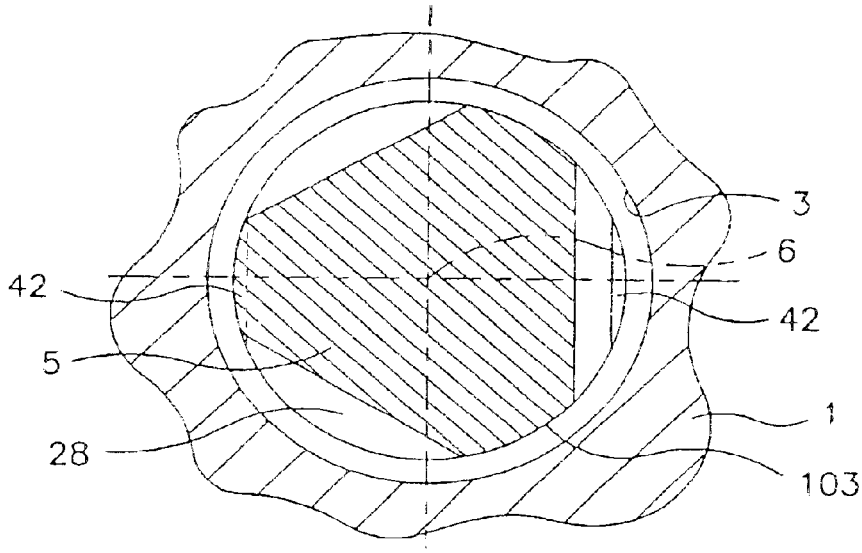
FIG. 5 shows a cross section along the line V—V in FIG. 4.
Figure 4:
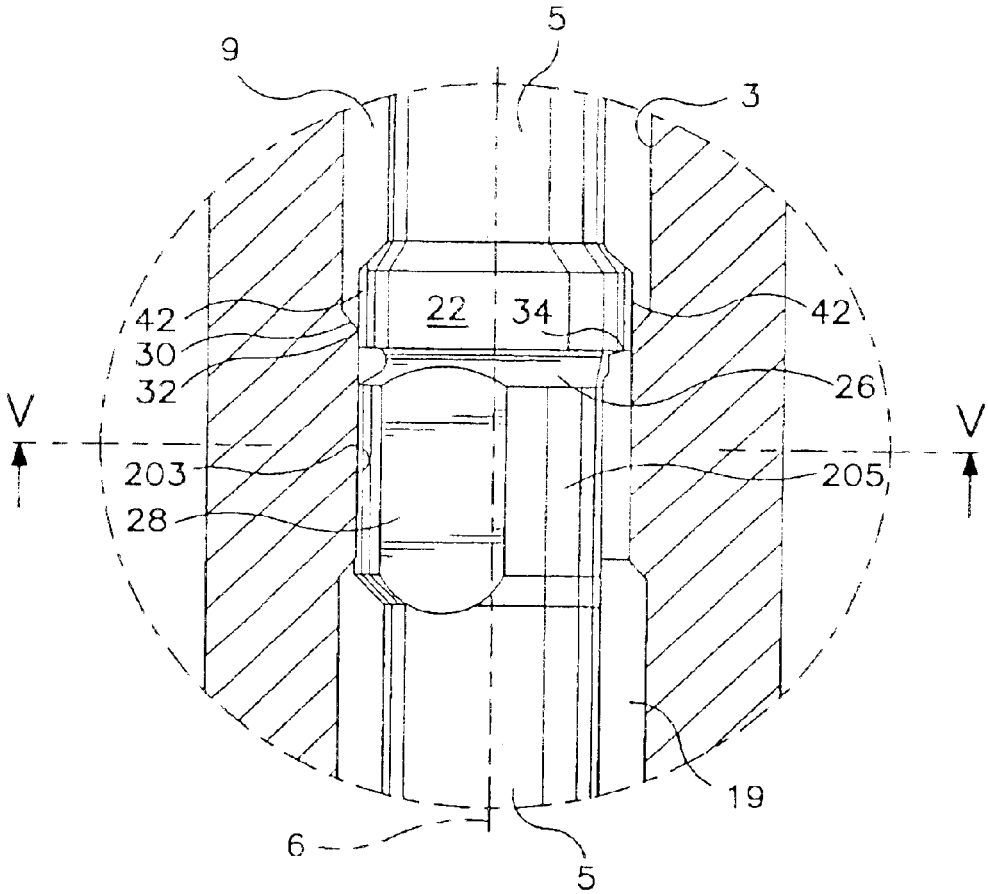
FIG. 4 shows the same detail as FIG. 2 of a different exemplary embodiment.

FIG. 4 shows another exemplary embodiment of the fuel injection valve according to the invention and FIG. 5 shows a cross section through the fuel injection valve shown in FIG. 4, along the line V—V. The throttle conduit between the first pressure chamber 9 and the second pressure chamber 19 in this instance is embodied by means of two throttle recesses 42 on the annular collar 22, which are embodied as flat grindings parallel to the longitudinal axis 6 of the valve member 5. It is also possible to provide more than two throttle recesses 42 on the annular collar 22. These are preferably distributed uniformly over the circumference of the annular collar 22 in order to permit a uniform fuel flow to the second pressure chamber 19.

In the exemplary embodiments in FIGS. 2 and 4, the annular shoulder 30 is embodied as inclined so that it encloses an angle with of the longitudinal axis 6 of the valve member 5. An annular shoulder 30, which is disposed in a radial plane of the valve member 5 would require a high cost in order to make the radius, which is required for technical production reasons, at the transition from the bore 3 into the annular shoulder 30 so small and within such strict tolerances that it does not run into the sealing edge 32. In addition, a radius of this kind would involve a sharp chamfer and would therefore involve a significant weakening of the valve body 1 and a reduced compression pulsating fatigue strength. In this instance, the location of the sealing edge 32 could only be exactly positioned with difficultly and could only be measured at a high cost. By contrast, an inclined annular shoulder 30 permits a larger radius with a greater tolerance, without running into the sealing edge 32. This permits the very important location of the sealing edge 32 to be favorably produced and measured.

The foregoing relates to preferred exemplary embodiments of the invention, it being understood that other variants and embodiments thereof are possible within the spirit and scope of the invention, the latter being defined by the appended claims.

What is claimed is:

1. In a fuel injection valve for internal combustion engines, having a valve body (1) with a bore (3) that contains a piston-shaped valve member (5) in a longitudinally movable fashion, which valve member (5) controls at least one injection opening (17) disposed at the end of the bore (3) oriented toward the combustion chamber and is guided in the bore (3) with a sealing section (105) remote from the combustion chamber and having an annular collar (22), which is disposed on the valve member (5) closer to the combustion chamber than the sealing section (105) and which has a side (37) oriented toward the combustion chamber and a side (36) oriented away from the combustion chamber and which annular collar (22) divides the space between the valve member (5) and the bore (3) into a first pressure chamber (9), which is oriented away from the combustion chamber and can be filled with fuel, and a second pressure chamber (19) which is oriented toward the combustion chamber, and having a bore guiding section (203) of the bore (3) into which the annular collar (22) plunges in the closed position of the valve member (5) and thus separates the two pressure chambers (9, 19) with the exception of a throttle cross section and out of which the annular collar (22) emerges during opening stroke motion of the valve member (5) and thus connects the pressure chambers (9, 19) to each other, the improvement wherein the throttle cross section is at least one throttle conduit (40, 42) having an inlet formed in the side (36) of the annular collar (22) oriented away from the combustion chamber and an outlet formed in the side (37) of the annular collar (22) oriented toward the combustion chamber and which connects the two sides (36, 37) of the annular collar (22) to each other.

2. The fuel injection valve according to claim 1 wherein the at least one throttle conduit (40) extends inside the valve member (5).

3. The fuel injection valve according to claim 2 wherein the at least one throttle conduit is embodied as a throttle bore (40), which extends at least approximately parallel to a longitudinal axis (6) of the valve member (5).

4. The fuel injection valve according to claim 3 wherein a large number of throttle bores (40) are provided, preferably distributed uniformly over a circumference of the annular collar (22).

5. The fuel injection valve according to claim 1 wherein the throttle conduit is embodied by means of at least one flat throttle recess (42) that is embodied on the annular collar (22) and is at least approximately parallel to the longitudinal axis (6) of the valve member (5).

6. The fuel injection valve according to claim 1 wherein the valve member (5) has a guiding section (205), which guides the valve member (5) in the bore guiding section (203) and is disposed closer to the combustion chamber than the annular collar (22); the guiding section (205) has at least one lateral grinding (28), which is disposed in an extension of the at least one throttle conduit (40).

* * * * *